US009611570B2

(12) United States Patent
Whiteman

(10) Patent No.: US 9,611,570 B2
(45) Date of Patent: Apr. 4, 2017

(54) DROP-STITCH FABRIC PNEUMATIC BAGS WITH CONTRASTING PARALLEL SURFACE THREAD PATTERN

(71) Applicant: AGE LOGISTICS CORPORATION, Monrovia, CA (US)

(72) Inventor: Richard F. Whiteman, Riverside, RI (US)

(73) Assignee: AGE Logistics Corporation, Monrovia, CA (US)

( * ) Notice: Subject to any disclaimer, the term of this patent is extended or adjusted under 35 U.S.C. 154(b) by 48 days.

(21) Appl. No.: 14/742,349

(22) Filed: Jun. 17, 2015

(65) Prior Publication Data

US 2016/0369431 A1 Dec. 22, 2016

(51) Int. Cl.

| | |
|---|---|
| ***D03D 1/02*** | (2006.01) |
| ***D03D 1/04*** | (2006.01) |
| ***D03D 11/00*** | (2006.01) |

(52) U.S. Cl.

CPC ..... *D03D 1/02* (2013.01); *D03D 1/04* (2013.01); *D03D 11/00* (2013.01)

(58) Field of Classification Search

CPC ..... Y10T 428/24174; Y10T 442/3472; D03D 1/02; D03D 11/02

USPC ..... 428/102, 119

See application file for complete search history.

(56) References Cited

U.S. PATENT DOCUMENTS

| | | |
|---|---|---|
| RE28,916 E | 7/1976 | Rice et al. |
| 4,251,893 A | 2/1981 | McCrory et al. |

OTHER PUBLICATIONS

Bagnell, Daniel G., Recent Advancements in the Development of Inflatable Multi-Hull Boats Utilizing Drop-Stitch Fabric, 11th International Conference on Fast Sea Transportation FAST 2011, Honolulu, Hawaii, USA, Sep. 2011, American Society of Naval Engineers, pp. 807-812.

(Public Government Document) Military Specification Cloth, Coated, and Webbing, Inflatable Boat and Miscellaneous Use, Document No. MIL-C-17415F, May 31, 1989, Source: http://www.assistdocs.com downloaded May 5, 2013, 20 pages.

(Public Government Document) J.O. Miller and E. Bilsky, Structural Fabric Program, ASD Interim Report 7-904 (III), Mar. 1962, Unclassified AD 274 309, Reproduced by Armed Services Technical Information Agency, Arlington Hall Station, Arlington 12, Virginia, 55 pages.

Catalog page, Tissavel. S.A., Specification Techniques, Sep. 1, 2006, 1 page.

Product Data Sheet, Age Logistics Corporation, Recovery Systems Aircraft Lifting Air Bags, Publication before 2014, 2 pages.

*Primary Examiner* — Alexander Thomas

(74) *Attorney, Agent, or Firm* — Jeffrey G. Sheldon; Lech Tishman Fuscaldo & Lampl

(57) ABSTRACT

A drop-stitch fabric includes an upper layer, a lower layer and a plurality of linear spaced-apart bow line threads woven across the weft of each layer. The bow line threads of each layer are of a color which contrasts with the color of its layer.

18 Claims, 3 Drawing Sheets

DROP-STITCH FABRIC PNEUMATIC BAGS WITH CONTRASTING PARALLEL SURFACE THREAD PATTERN

BACKGROUND

Drop-stitch fabric pneumatic bags are used in a wide variety of applications. In one important application, drop-stitch fabric pneumatic bags are used to prop up and support heavy machinery, such as damaged aircraft sections.

As explained in the paper "Recent Advancements in the Development of Inflatable Multi-Hull Boats" (Daniel G. Bagnell, 11th International Conference on Fast Sea Transportation, Honolulu, Hi., September 2011), drop-stitch fabric (also commonly termed "drop-thread" fabric) can be compared to cored, composite structures, i.e., a core material with an outer laminate on both faces. The cored material in drop-stitch fabrics consists of two pieces of fabric that are connected, sandwich style, by a series of rows of "stitches," The "stitching" process leaves an excess amount of thread between the two pieces of fabric in such a manner that when the two pieces of material are separated, the faces of the panel are held at a fixed distance from each other at a distance which is equal to the length of the excess thread.

Drop-stitch fabric is typically woven from polyethylene terephthalate or nylon thread. It is not stitched, although it appears to be stitched, hence the name "drop-stitch." It can be found that each thread used in the weaving process is woven several times in the warp direction, then up (or down) forming the "drop stitch," and then several times in the weft direction before running down (or up) again. This process assures that the fabric cannot unravel. The weaving process is such that there are approximately 50 "stitches" or threads per square inch. The thickness of this core can be as small as desired, hut generally does not get much less than 2 inches. Maximum thicknesses are reported to be as much as 30 inches and are a function of the physical constraints of the weaving loom. Additionally, some looms are capable of varying the length of the threads linearly in one direction to form a complex structure.

Drop-stitch fabric are typically woven in different grades, such as standard grades and heavy duty grades. The standard grade is generally rated for use up to about 0.7 bar and the heavy duty to about 1.0 bar.

Greige drop-stitch fabrics are not air-tight and must be coated with a sealant. FIGS. 1 and 2 illustrate an inflatable, pneumatic panel 10 made from a finished drop-stitch fabric 12, comprising a greige drop-stitch fabric 14 covered with a sealant 16.

The advantages of drop-stitch fabrics are two-fold. First, drop-stitch fabrics demonstrate structural properties similar to plywood. A drop-stitch panel can withstand large loads, and associated large deflections, before failure. However, unlike plywood where the plys will delaminate at failure, if a drop-stitch panel collapses under a large load, it will rebound to its original shape when the load is removed.

The second advantage of drop-stitch fabrics is that, if properly manufactured, drop-stitch fabrics can be used to form pneumatic structures which, when inflated, are not only rigid but also constructed to take on a predetermined shape. The shapes can be quite complex. For example, drop-stitch fabrics have been used to form fully air-worthy inflatable aircraft. FIG. 2 illustrates a common form of drop stitch panel wherein the shape of the panel is a rectangular parallelepiped. FIG. 3 illustrates a plurality of rectangular parallelepiped-shaped drop-stitch panels being used to support the wing 18 of an aircraft 20.

One of the challenging problems in making a drop-stitch fabric is that, in the course of processing and handling the fabric, the fabric can become misaligned. That is to say a drop-stitch fabric can be pulled in the "x" or "y" axis in ways that are not always uniform. Such misalignment of the fabric (often termed "bow" or "scalloping") is caused by the top and/or bottom backing layers being "stretched" more at the middle than at the edges (or vice versa) during weaving, scouring, drying and/or rewinding.

It is difficult to see misalignments during production, as all the yarn woven in both warp (length) and weft (width) is of the same color. The manufacturer can easily scour and dry 200 yards of fabric and never realize that it is misaligned. Once the fabric is coated with sealant, the misalignment is essentially locked-in and cannot be easily corrected. This can be extremely costly to the manufacturer.

An example of an unacceptable drop-stitch fabric product is shown in FIGS. 4A and 4B which illustrates a rectangular parallelepiped-shaped drop-stitch fabric pneumatic bag 8 wherein the upper surface 9 is "bowed," rather than being flat.

There is a need, therefore, for a drop-stitch fabric and a method of forming a drop-stitch fabric which avoid the aforementioned problems in the prior art.

SUMMARY OF THE INVENTION

The invention satisfies this need. In one aspect, the invention is a greige drop-stitch fabric comprising: a) a woven upper layer, the upper layer comprised of woven threads of a first visual appearance; b) a woven lower layer, the lower layer comprised of woven threads of a second visual appearance; c) a plurality of connecting threads connecting the upper layer and the lower layer such that the upper layer and lower layers can be positioned with respect to one another between a collapsed position wherein all or most portions of the upper layer are contiguous with the lower layer and a fully expanded position wherein the upper layer is disposed spaced apart from the lower layer, the connecting threads being of a length wherein, when the upper and lower layers are in the fully expanded position, all or most portions of the upper layer are spaced apart from opposing portions of the lower layer by a predetermined distance; d) a plurality of upper layer bow line threads woven across the weft of the upper layer, each upper layer bow line thread being disposed in linear fashion and spaced apart from adjoining upper layer bow line threads, each upper layer bow line thread being of a color which contrasts sufficiently with the first visual appearance so as to be discernable; and e) a plurality of lower layer bow line threads woven across the weft of the lower layer, each lower layer bow line thread being disposed in linear fashion and spaced apart from adjoining lower layer bow line threads by distances of between about one centimeter and about 50 centimeters, each lower layer bow line thread being of a color which contrasts sufficiently with the second visual appearance so as to be discernable.

In another aspect, the invention is a method of making a finished drop-stitch fabric comprising the steps of: a) weaving the greige drop-stitch fabric of the invention described immediately above; b) performing one or more processing steps on the greige drop-stitch fabric chosen form the list of processing steps consisting of scouring, drying and rewinding; c) during the weaving of the greige drop-stitch fabric in step a) or in the processing of the greige drop-stitch fabric in step b) or in both the greige drop-stitch fabric in step a) and in the processing of the greige drop-stitch fabric in step b), observing the linearity of the plurality of upper layer bow line threads or the plurality of lower layer bow line threads or both the plurality of upper layer bow line threads and the plurality of lower layer bow line threads; d) if one or more of the plurality of upper layer bow line threads or the plurality of lower layer bow line threads or both the plurality of upper layer bow line threads and the plurality of lower layer bow line threads are observed to be non-linear because of one or more weaving misalignments proximate to such non-linear bow line threads, correcting such weaving misalignments; and e) when all of the bow line threads are observed to be linear, sealing the greige drop-stitch fabric to yield the finished drop-stitch fabric.

DRAWINGS

These and other features, aspects and advantages of the present invention will become better understood with reference to the following description, appended claims, and accompanying drawings where:

DETAILED DESCRIPTION OF THE INVENTION

Figure 1:
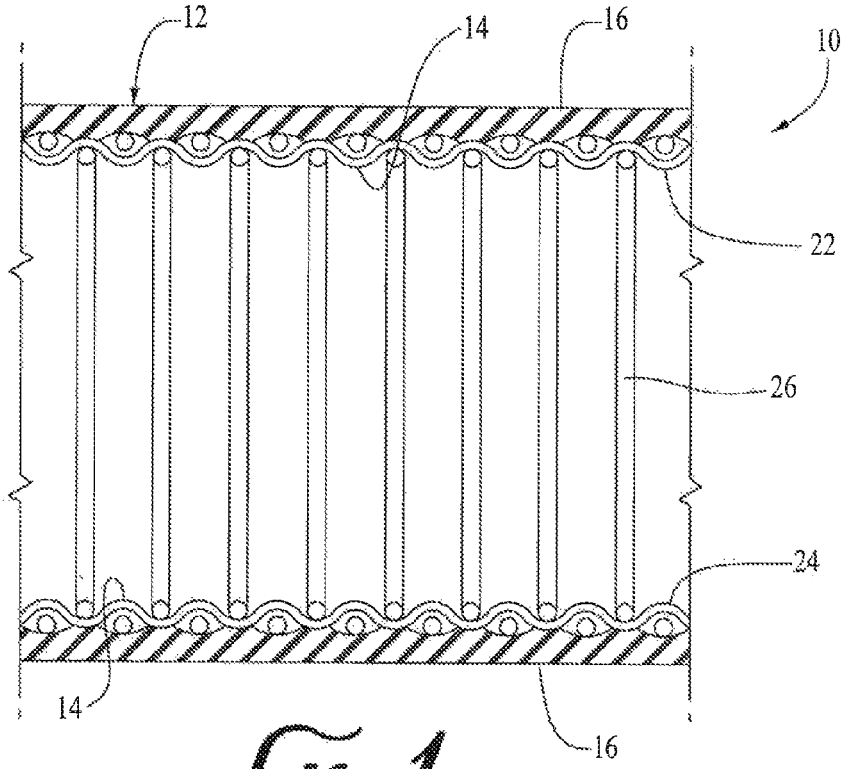
FIG. 1 PRIOR ART
FIG. 1 is a cross-sectional sketch of the interior of a generalized drop-stitch fabric pneumatic panel to which the invention can be directed.
Figure 4A:
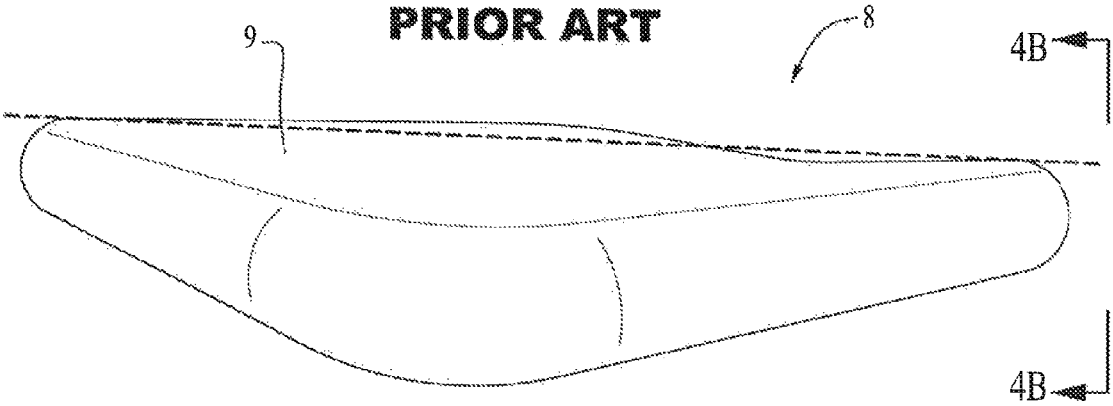
FIG. 4A PRIOR ART
FIG. 4A is a perspective view of a drop-stitch fabric pneumatic panel having a bowed upper surface.
Figure 4B:
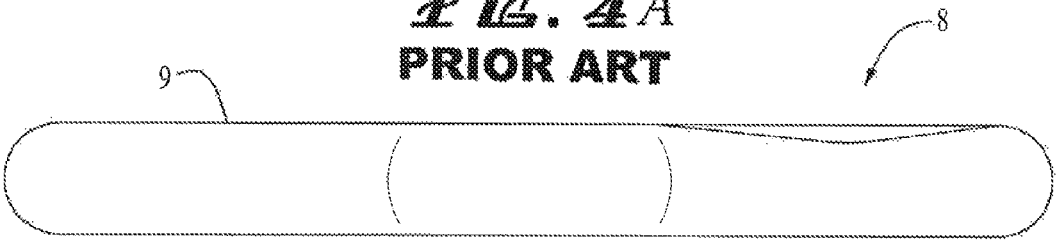
FIG. 4B PRIOR ART
FIG. 4B is an end view of the drop-stitch fabric pneumatic panel illustrated in FIG. 4A.

The following discussion describes in detail one embodiment of the invention and several variations of that embodiment. This discussion should not be construed, however, as limiting the invention to those particular embodiments. Practitioners skilled in the art will recognize numerous other embodiments as well.

DEFINITIONS

As used herein, the following terms and variations thereof have the meanings given bolo unless a different meaning is clearly intended by the context in which such term is used.

The terms "a," "an," and "the" and similar referents used herein are to be construed to cover both the singular and the plural unless their usage in context indicates otherwise.

As used in this disclosure, the term "comprise" and variations of the term, such as "comprising" and "comprises," are not intended to exclude other additives, components, integers, ingredients or steps.

The Invention

In one aspect, the invention is a finished drop-stitch fabric 12 and a greige drop-stitch fabric 14 comprising a woven upper layer 22, a woven lower layer 24, a plurality of connecting threads 26 connecting the upper layer 22 and the lower layer 24, a plurality of upper layer bow line threads 28 woven across the weft of the upper layer and a plurality of lower layer bow line threads 30 woven across the weft of the lower layer. By "greige drop-stitch fabric," it meant herein that the drop-stitch fabric is unsealed.

Both the upper layer 22 and the lower layer 24 are typically woven from polyethylene terephthalate or nylon thread, although other suitable thread materials can be used.

The woven upper layer 22 is comprised of woven upper layer base threads 32 of a first visual appearance. Typically the woven upper layer 22 is comprised of upper base threads 32 of the same color as one another.

The woven lower layer 24 is comprised of woven lower layer base threads 34 of a second visual appearance. Typically the woven lower layer 24 is comprised of lower layer base threads 34 of the same color as one another, most typically of the same color as the upper layer base threads 32.

In the plurality of connecting threads 26, each connecting thread 26 used in the weaving process is woven several times in the warp direction, then up (or down) forming the "drop stitch," and then several times in the well direction before running down (or up) again. This process assures that the fabric 14 cannot unravel. The weaving process is typically such that there are approximately 50 "stitches" or threads per square inch.

Figure 2:
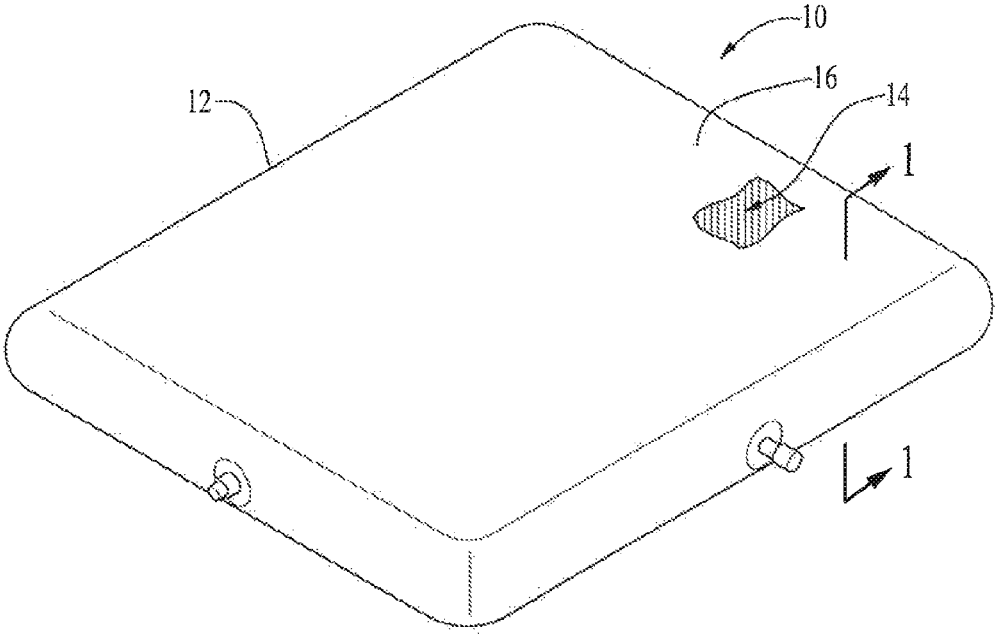
FIG. 2 PRIOR ART
FIG. 2 is a perspective view of a drop-stitch fabric pneumatic panel having non-bowed upper and lower surfaces manufactured using drop-stitch fabric having features of the invention.
Figure 3:
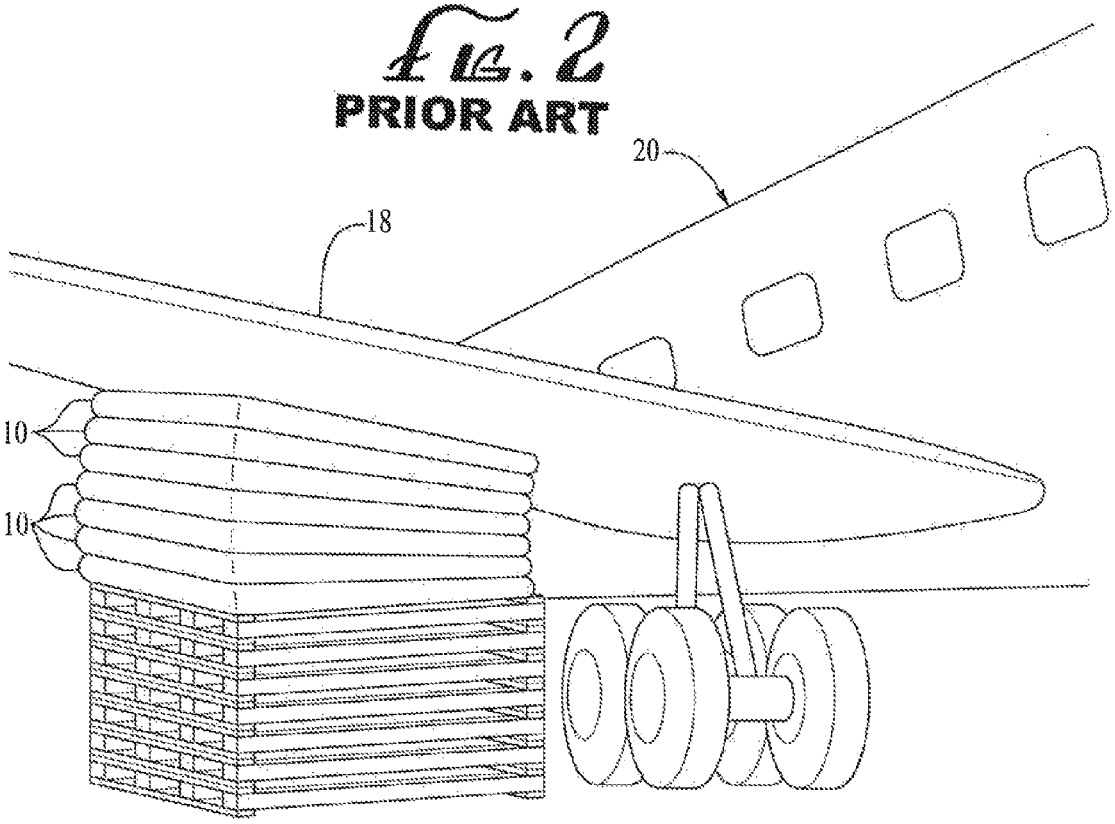
FIG. 3 PRIOR ART
FIG. 3 is a perspective view of seven drop-stitch fabric pneumatic panels shown supporting an aircraft wing.
Figure 5:
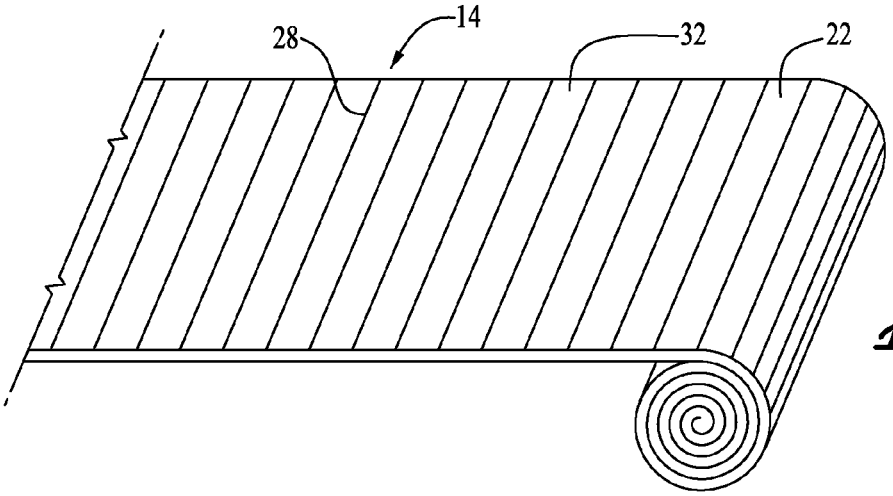
FIG. 5 is a perspective view of the upper side of a first drop-stitch fabric having features of the invention, showing how the contrasting lateral threads confirm the proper alignment of the web.
Figure 6:
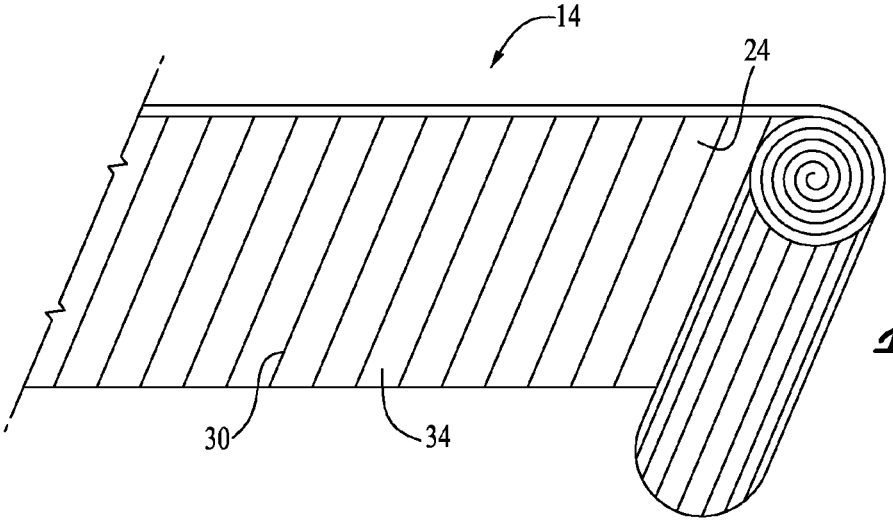
FIG. 6 is a perspective view of the lower side of the drop-stitch fabric illustrated in FIG. 5, showing how the contrasting lateral threads confirm the proper alignment of the web.
Figure 7:
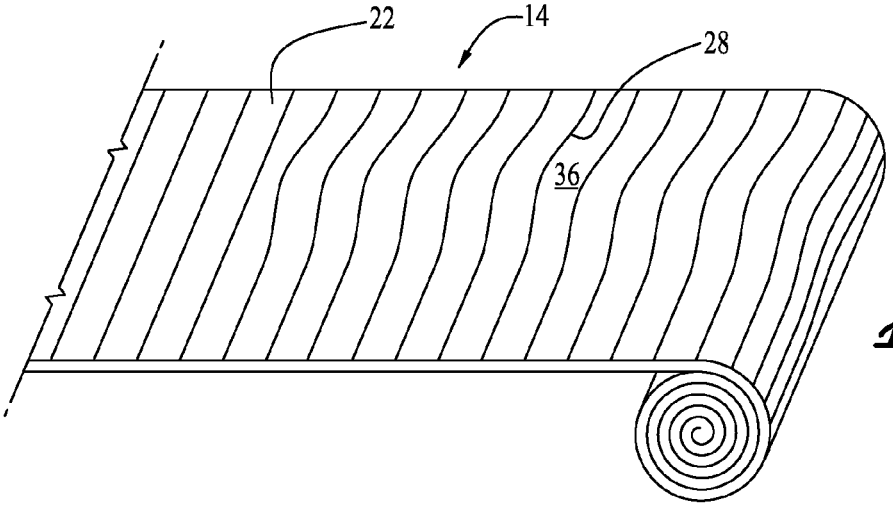
FIG. 7 is a perspective view of the upper side of a second drop-stitch fabric having features of the invention, showing how the contrasting lateral threads identify misalignment portions in the web.

The plurality of connecting threads 26 connects the upper layer 22 and the lower layer 24 such that the upper layer 22 and lower layer 24 can be positioned with respect to one another between (1) a collapsed position wherein the all or most portions of the upper layer 22 are contiguous with the lower layer 24 (as illustrated in FIGS. 5-7) and (2) a fully expanded position wherein all or most portions of the upper layer 22 are disposed spaced apart from the lower layer 24 (as illustrate in FIGS. 1-3). The connecting threads 26 are each of a length such that, when the upper and lower layers 22 and 24 are in the fully expanded position, all or most portions of the upper layer 22 are spaced apart from opposing portions of the lower layer 24 by a predetermined distance.

The plurality of upper layer bow line threads 28 are disposed in linear fashion and spaced apart from adjoining upper layer bow line threads 28, typically by distances of between about one centimeter and about 50 centimeters, most typically between about 10 centimeters and about 25 centimeters. Each upper layer bow line thread 28 is of a color which contrasts sufficiently with the first visual appearance so as to be readily discernable, such as with the naked eye at distance of about 5 feet or less.

The plurality of lower layer bow line threads 30 are also disposed in linear fashion and spaced apart from adjoining lower layer bow line threads 30, typically by distances of between about one centimeter and about 50 centimeters, most typically between about 10 centimeters and about 25 centimeters. Each lower layer bow line thread 30 is of a color which contrasts sufficiently with the second visual appearance so as to be readily discernable, such as with the naked eye at distance of about 5 feet or less.

In one embodiment, the color of the lower layer bow line threads 30 is different than the color of the upper layer bow line threads 28, to facilitate recognition of the lower layer 24 from the upper layer 22 during the manufacturing process.

FIGS. 5 and 6 illustrate the upper layer 22 and the lower layer 24, respectively, of a greige drop-stitch fabric 14 of the present invention having contrasting linear bow line threads 28 and 30 disposed in parallel and spaced apart by about 6 inches. FIGS. 5 and 6 illustrate a greige drop-stitch fabric 14 of the invention having no discernable areas of misalignment.

FIGS. 5 and 6 are contrasted with FIG. 7. FIG. 7 illustrates the upper layer 22 of a greige drop-stitch fabric 14 of the present invention wherein the upper layer bow line threads 28 are not totally linear indicating an area of misalignment 36. Those of skill in the art will readily recognize how the contrasting bow lines threads 28 and 30 make areas of proper alignment and areas of misalignment 36 immediately discernable to the manufacturer.

All faces of the greige drop-stitch fabric 14 are sealed, typically by coating or laminating the faces with a non-permeable elastomer sealant 16 such as polyester, PVC, neoprene, urethane, etc., to make the structure air-tight. This sealant 16 can be applied as solid sheets that are glued to the greige drop-stitch fabric 14 or by a hot calendaring process where the faces of the greige drop-stitch fabric 14 are impregnated with the sealant 16 to form a finished drop-stitch fabric 12.

To form a final inflatable panel structure 10, the edges of the two outer laminates are typically sealed by welding the laminates or, in the case of panels that have been coated using a calendaring process, gluing a non-drop-stitch fabric tape around the perimeter. As noted above, FIG. 2 illustrates a typical inflatable panel structure 10 made from a finished drop-stitch fabric 12.

In a second aspect, the invention is a method of making a finished drop-stitch fabric 12 comprising the steps of:

a) weaving a greige drop-stitch fabric 14 comprising:

i) a woven upper layer 22, the upper layer 22 comprised of woven threads 32 of a first visual appearance;

ii) a woven lower layer 24, the lower layer 24 comprised of woven threads 34 of a second visual appearance;

iii) a plurality of connecting threads 26 connecting the upper layer 22 and the lower layer 24, such that the upper layer 22 and lower layer 24 can be positioned with respect to one another between a collapsed position wherein all or most portions of the upper layer 22 are contiguous with the lower layer 24 and a fully expanded position wherein the upper layer 22 is disposed spaced apart from the lower layer 24, the connecting threads 36 being of a length wherein, when the upper and lower layers 22 and 24 are in the fully expanded position, all or most portions of the upper layer 22 are spaced apart from opposing portions of the lower layer 24 by a predetermined distance;

iv) a plurality of upper layer bow line threads 28 woven across the weft of the upper layer 22, each upper layer bow line thread 28 being disposed in linear fashion and spaced apart from adjoining upper layer bow line threads 28, such as by distances of between about one centimeter and about 50 centimeters, each upper layer bow line thread 28 being of a color which contrasts sufficiently with the first visual appearance so as to be readily discernable, such as with the naked eye at a distance of 5 feet or less; and v) a plurality of lower layer bow line threads 30 woven across the weft of the lower layer 24, each lower layer bow line thread 30 being disposed in linear fashion and spaced apart from adjoining lower layer bow line threads 30 such as by distances of between about one centimeter and about 50 centimeters, each lower layer bow line thread 30 being of a color which contrasts sufficiently with the second visual appearance so as to be readily discernable, such as by with the naked eye at a distance of about 6 feet or less;

b) performing one or more processing steps on the greige drop-stitch fabric 14 chosen form the list of processing steps consisting of scouring, drying and rewinding;

c) during the weaving of the greige drop-stitch fabric 14 in step a) or in the processing of the greige drop-stitch fabric 14 in step b) or in both the weaving of the greige drop-stitch fabric 14 in step a) and in the processing of the greige drop-stitch fabric 14 in step b), observing the linearity of the plurality of upper layer bow line threads 28 or the plurality of lower layer bow line threads 30 or both the plurality of upper layer bow line threads 28 and the plurality of lower layer bow line threads 30;

d) if one or more of the plurality of upper layer how line threads 28 or the plurality of lower layer how line threads 30 or both the plurality of upper layer bow line threads 28 and the plurality of lower layer bow line threads 30 are observed to be non-linear (as in FIG. 7), correcting weaving misalignments 36 proximate to such non-linear bow line threads 28 and/or 30; and e) when all of the bow line threads 28 and 30 observed in step c) are observed to be linear (as in FIGS. 5 and 6), sealing the greige drop-stitch fabric 14 to yield the finished drop-stitch fabric 12.

The invention allows the manufacturer of drop-stitch fabrics to identify and correct areas of misalignment in the griege fabric before the fabric is formed into structures and coated with sealant. This results in considerable cost savings to the manufacturer of drop-stitch fabrics.

What is claimed is:

1. A greige drop-stitch fabric comprising:

a) a woven upper layer, the upper layer comprised of woven threads of a first visual appearance;

b) a woven lower layer, the lower layer comprised of woven threads of a second visual appearance;

c) a plurality of connecting threads connecting the upper layer and the lower layer such that the upper layer and lower layers can be positioned with respect to one another between a collapsed position wherein all or most portions of the upper layer are contiguous with the lower layer and a fully expanded position wherein the upper layer is disposed spaced apart from the lower layer, the connecting threads being of a length wherein, when the upper and lower layers are in the fully expanded position, all or most portions of the upper layer are spaced apart from opposing portions of the lower layer by a predetermined distance;

d) a plurality of upper layer bow line threads woven across the weft of the upper layer, each upper layer bow line thread being disposed in linear fashion and spaced apart from adjoining upper layer bow line threads, each upper layer bow line thread being of a color which contrasts sufficiently with the first visual appearance so as to be discernable; and e) a plurality of lower layer bow line threads woven across the weft of the lower layer, each lower layer bow line thread being disposed in linear fashion and spaced apart from adjoining lower layer bow line threads by distances of between about one centimeter and about 50 centimeters, each lower layer bow line thread being of a color which contrasts sufficiently with the second visual appearance so as to be discernable.

2. The greige drop-stitch fabric of claim 1 wherein, when the upper layer and lower layers are positioned in the collapsed position, all portions of the upper layer are contiguous with the lower layer.

3. The greige drop-stitch fabric of claim 1 wherein, when the upper and lower layers are in the fully expanded position, all portions of the upper layer are spaced apart from opposing portions of the lower layer by a predetermined distance.

4. The greige drop-stitch fabric of claim 1 wherein the upper layer bow line threads and the lower layer bow line threads are spaced apart from adjoining bow line threads by a distance of between about one centimeter and about 50 centimeters.

5. The greige drop-stitch fabric of claim 1 wherein the upper layer bow line threads and the lower layer bow line threads are spaced apart from adjoining bow line threads by a distance of between about 10 centimeters and about 25 centimeters.

6. The greige drop-stitch fabric of claim 1 wherein each upper layer bow line thread is of a color which contrasts sufficiently with the first visual appearance so as to be discernable by the naked eye at distances of 6 feet or less.

7. The greige drop-stitch fabric of claim 1 wherein each lower layer bow line thread is of a color which contrasts sufficiently with the second visual appearance so as to be discernable by the naked eye at distances of 6 feet or less.

8. The greige drop-stitch fabric of claim 1 wherein the color of the upper layer bow line threads is different than the color of the lower bow line threads.

9. A finished drop-stitch fabric comprising:

a) the greige drop-stitch fabric of claim 1; and b) a sealant disposed on the upper layer and on the lower layer.

10. An inflatable panel comprising panel walls made from the finished drop-string fabric of claim 9.

11. A method of making a finished drop-stitch fabric comprising the steps of:

a) weaving a greige drop-stitch fabric comprising:

i) a woven upper layer, the upper layer comprised of woven threads of a first visual appearance;

ii) a woven lower layer, the lower layer comprised of woven threads of a second visual appearance;

iii) a plurality of connecting threads connecting the upper layer and the lower layer such that the upper layer and lower layers can be positioned with respect to one another between a collapsed position wherein all or most portions of the upper layer are contiguous with the lower layer and a fully expanded position wherein the upper layer is disposed spaced apart from the lower layer, the connecting threads being of a length wherein, when the upper and lower layers are in the fully expanded position, all or most portions of the upper layer are spaced apart from opposing portions of the lower layer by a predetermined distance;

iv) a plurality of upper layer bow line threads woven across the weft of the upper layer, each upper layer bow line thread being disposed in linear fashion and spaced apart from adjoining upper layer bow line threads, each upper layer bow line thread being of a color which contrasts sufficiently with the first visual appearance so as to be discernable; and v) a plurality of lower layer bow line threads woven across the weft of the lower layer, each lower layer bow line thread being disposed in linear fashion and spaced apart from adjoining lower layer bow line threads, each lower layer bow line thread being of a color which contrasts sufficiently with the second visual appearance so as to be discernable;

b) performing one or more processing steps on the greige drop-stitch fabric chosen from the list of processing steps consisting of scouring, drying and rewinding;

c) during the weaving of the greige drop-stitch fabric in step a) or in the processing of the greige drop-stitch fabric in step b) or in both the greige drop-stitch fabric in step a) and in the processing of the greige drop-stitch fabric in step b), observing the linearity of the plurality of upper layer bow line threads or the plurality of lower layer bow line threads or both the plurality of upper layer bow line threads and the plurality of lower layer bow line threads;

d) if one or more of the plurality of upper layer bow line threads or the plurality of lower layer bow line threads or both the plurality of upper layer bow line threads and the plurality of lower layer bow line threads are observed to be non-linear because of one or more weaving misalignments proximate to such non-linear bow line threads, correcting such weaving misalignments; and e) when all of the bow line threads observed in step c) are observed to be linear, sealing the greige drop-stitch fabric to yield the finished drop-stitch fabric.

12. The method of claim 11 wherein, when the upper layer and lower layers are positioned in the collapsed position, all portions of the upper layer are contiguous with the lower layer.

13. The method of claim 11 wherein, when the upper and lower layers are in the fully expanded position, all portions of the upper layer are spaced apart from opposing portions of the lower layer by a predetermined distance.

14. The method of claim 11 wherein the upper layer bow line threads and the lower layer bow line threads are spaced apart from adjoining bow line threads by a distance of between about one centimeter and about 50 centimeters.

15. The method of claim 11 wherein the upper layer bow line threads and the lower layer bow line threads are spaced apart from adjoining bow line threads by a distance of between about 10 centimeters and about 25 centimeters.

16. The method of claim 11 wherein each upper layer bow line thread is of a color which contrasts sufficiently with the first visual appearance so as to be discernable by the naked eye at distances of 6 feet or less.

17. The method of claim 11 wherein each lower layer bow line thread is of a color which contrasts sufficiently with the second visual appearance so as to be discernable by the naked eye at distances of 6 feet or less.

18. The method of claim 11 wherein the color of the upper layer bow line threads is different than the color of the lower bow line threads.

* * * * *